US008563209B2

(12) United States Patent
Horiba et al.

(10) Patent No.: US 8,563,209 B2
(45) **Date of Patent: *Oct. 22, 2013**

(54) LIQUID DEVELOPER, DEVELOPER CARTRIDGE, IMAGE FORMING METHOD, AND IMAGE FORMING APPARATUS

(75) Inventors: Koji Horiba, Kanagawa (JP); Yoshihiro Inaba, Kanagawa (JP); Ryosaku Igarashi, Kanagawa (JP); Akira Imai, Kanagawa (JP); Takako Kobayashi, Kanagawa (JP); Daisuke Yoshino, Kanagawa (JP); Takahiro Ishizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 113 days.

This patent is subject to a terminal disclaimer.

(21) Appl. No.: 13/212,625

(22) Filed: Aug. 18, 2011

(65) Prior Publication Data

US 2012/0189954 A1 Jul. 26, 2012

(30) Foreign Application Priority Data

Jan. 24, 2011 (JP) ..... 2011-011911

(51) Int. Cl.
*G03G 9/13* (2006.01)

(52) U.S. Cl.
USPC ..... 430/112; 430/114

(58) Field of Classification Search
USPC ..... 430/112, 114
See application file for complete search history.

(56) References Cited

U.S. PATENT DOCUMENTS

| | | | | |
|---|---|---|---|---|
| 4,181,620 | A | 1/1980 | Tsubuko | |
| 4,473,629 | A | 9/1984 | Herrmann et al. | |
| 4,957,844 | A | 9/1990 | Page | |
| 5,106,717 | A | 4/1992 | Houle et al. | |
| 6,190,816 | B1 | 2/2001 | Takehara et al. | |
| 6,649,316 | B2 | 11/2003 | Baker et al. | |
| 7,008,744 | B2 | 3/2006 | Horie et al. | |
| 7,405,027 | B2 * | 7/2008 | Chou et al. | 430/137.15 |
| 2004/0006158 | A1 | 1/2004 | Horie et al. | |
| 2008/0248413 | A1 * | 10/2008 | Ishii et al. | 430/48 |
| 2012/0141933 | A1 * | 6/2012 | Inaba et al. | 430/114 |
| 2013/0078568 | A1 * | 3/2013 | Inaba et al. | 430/112 |

FOREIGN PATENT DOCUMENTS

| | | |
|---|---|---|
| EP | 0 390 105 A2 | 10/1990 |
| EP | 0 406 518 A1 | 1/1991 |
| JP | A-58-59458 | 4/1983 |
| JP | A-58-59459 | 4/1983 |

(Continued)

OTHER PUBLICATIONS

Machine English language translation of JP 2002-123040, Apr. 26, 2002.*

(Continued)

*Primary Examiner* — Hoa V Le
(74) *Attorney, Agent, or Firm* — Oliff & Berridge, PLC

(57) ABSTRACT

A liquid developer includes: a carrier liquid and toner particles dispersed in the carrier liquid, including a binder resin which contains a thermoplastic resin having repeating units derived from a monomer having a styrene skeleton and repeating units derived from a monomer having an acrylic ester structure, and a thermoplastic elastomer resin that is a block copolymer, the block copolymer having a first block portion including repeating units derived from a monomer having a styrene skeleton, a second block portion including repeating units derived from an alkene having 2 to 6 carbon atoms, and a third block portion including repeating units derived from a monomer having a styrene skeleton and these block portions being bonded in this order.

9 Claims, 1 Drawing Sheet

(56) References Cited

FOREIGN PATENT DOCUMENTS

| | | |
|---|---|---|
| JP | A-58-59460 | 4/1983 |
| JP | A-3-296067 | 12/1991 |
| JP | A-7-84407 | 3/1995 |
| JP | A-7-219269 | 8/1995 |
| JP | A-8-123080 | 5/1996 |
| JP | A-11-184149 | 7/1999 |
| JP | A-2000-181141 | 6/2000 |
| JP | A-2001-175031 | 6/2001 |
| JP | A-2002-123040 | 4/2002 |
| JP | A-2004-205843 | 7/2004 |
| JP | A-2007-79348 | 3/2007 |

OTHER PUBLICATIONS

U.S. Appl. No. 13/149,098, filed May 31, 2011.
Dec. 5, 2012 Office Action issued in U.S. Appl. No. 13/149,098.
Apr. 4, 2013 Office Action issued in U.S. Appl. No. 13/149,098.
Mar. 21, 2012 Extended European Search Report issued in European Patent Application No. 11172798.8.
Aug. 1, 2013 Office Action issued in U.S. Appl. No. 13/149,098.

* cited by examiner

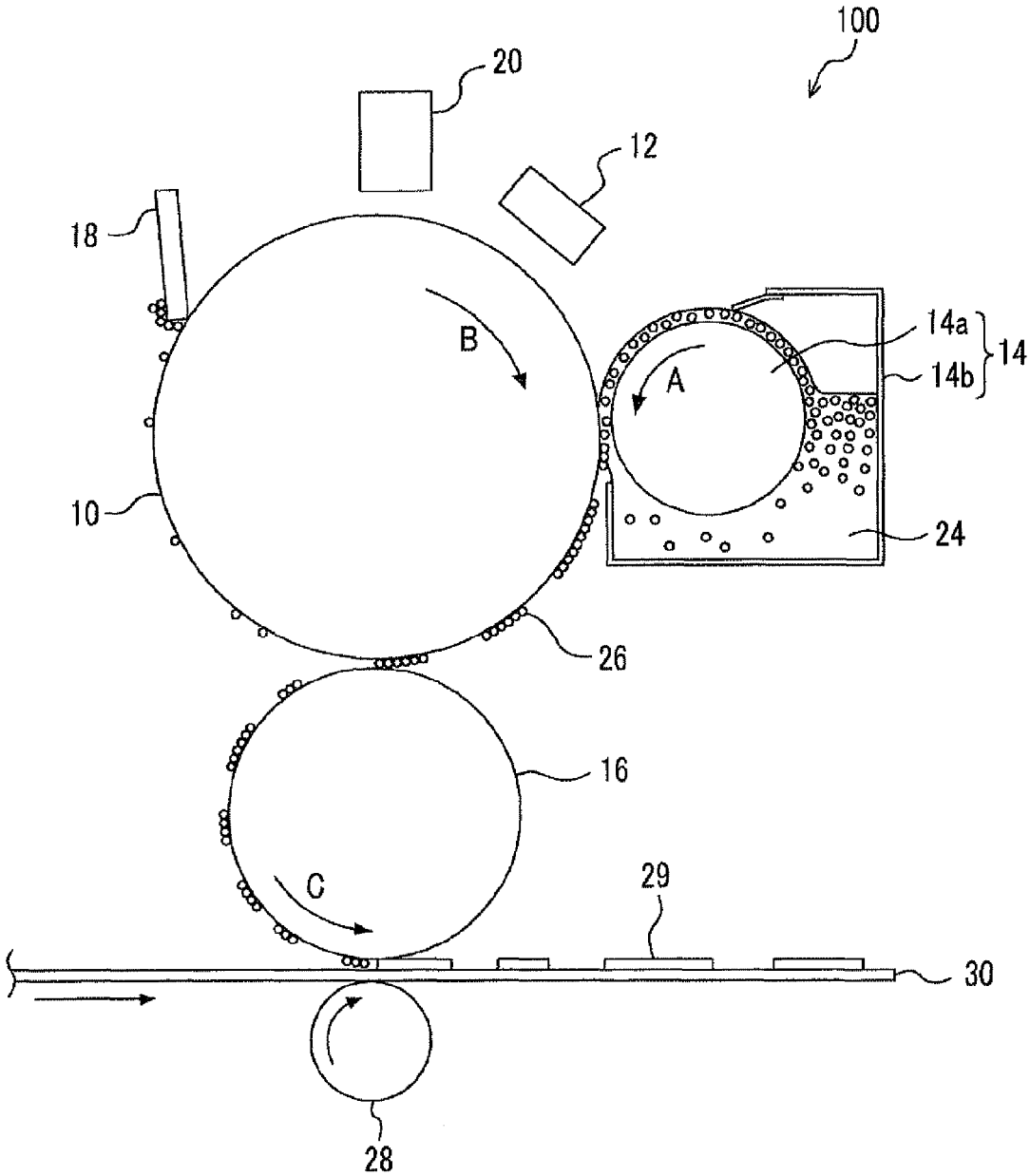
100
20
12
18
B
A
14a
14
14b
10
24
26
16
C
29
30
28

LIQUID DEVELOPER, DEVELOPER CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-011911 filed Jan. 24, 2011.

BACKGROUND

Technical Field

The present invention relates to a liquid developer, a developer cartridge, an image forming method, and an image forming apparatus.

SUMMARY

According to an aspect of the invention, there is provided a liquid developer including a carrier liquid, and toner particles dispersed in the carrier liquid, including a binder resin which contains a thermoplastic resin having repeating units derived from a monomer having a styrene skeleton and repeating units derived from a monomer having an acrylic ester structure, and a thermoplastic elastomer resin that is a block copolymer, the block copolymer having a first block portion including repeating units derived from a monomer having a styrene skeleton, a second block portion including repeating units derived from an alkene having 2 to 6 carbon atoms, and a third block portion including repeating units derived from a monomer having a styrene skeleton and these block portions being bonded in this order.

BRIEF DESCRIPTION OF THE DRAWING

Exemplary embodiment of the present invention will be described in detail based on the following FIGURE, wherein:

FIG. 1 is a schematic constitutional view showing an example of the image forming apparatus of some aspects of the present invention.

DETAILED DESCRIPTION

[Liquid Developer]

The liquid developer according to the present exemplary embodiment has toner particles including a binder resin containing a thermoplastic resin and a thermoplastic elastomer resin, and a carrier liquid. Further, as the thermoplastic resin, a resin having repeating units derived from a monomer having a styrene skeleton (hereinafter sometimes referred to as a "styrene-based monomer") and repeating units derived from a monomer having an acrylic ester structure (hereinafter sometimes referred to as an "acrylic ester-based monomer") (in which the resin is hereinafter sometimes referred to as a "styrene-acrylic ester copolymer") is used. Further, as the thermoplastic elastomer resin, a block copolymer in which a first block portion including repeating units derived from a styrene-based monomer, a second block portion including repeating units derived from an alkene having 2 to 6 carbon atoms, and a third block portion including repeating units derived from a styrene-based monomer are bonded in this order (in which the block copolymer is hereinafter sometimes referred to as a "styrene-alkylene-styrene block copolymer") is used.

Here, the "repeating units derived from a styrene-based monomer" mean repeating units produced by the reaction of the styrene-based monomer among the repeating units constituting the polymer. This shall apply to the repeating units derived from other monomers.

The above-described constitution of the liquid developer of the present exemplary embodiment makes it possible that aggregation of the toner particles is difficult even when the liquid developer is left to stand, as compared with a case of other constitutions than the above-described constitution (for example, a constitution where a thermoplastic elastomer resin other than the styrene-alkylene-styrene block copolymer is used, and the like). The reason therefor is not clear, but is presumed to be as follows.

In the present exemplary embodiment, as described above, a combination of a thermoplastic resin which is a styrene-acrylic ester copolymer and a thermoplastic elastomer resin which is a styrene-alkylene-styrene block copolymer is used as a binder resin. Thus, it is presumed that since the compatibility between the thermoplastic resin and the thermoplastic elastomer resin is favorable, the thermoplastic elastomer resin in the toner particles easily exists in a continuous state, and even when the thermoplastic elastomer resin is present unevenly, the boundary between the area of the thermoplastic elastomer resin and the area of the thermoplastic resin is likely to be ambiguous.

Here, the "continuous state" may be, for example, a state where an area with a diameter 100 μm or more in which the thermoplastic elastomer resin is present unevenly is not observed in a TEM image obtained by observation of the inside of the toner particle with a permeation type electron microscope (for example, magnification 30000 times, acceleration voltage: 30 kV). Further, the expression "the boundary is ambiguous" may be, for example, a case where in the TEM image, the shades slowly change from the area of thermoplastic elastomer resin to the area of the thermoplastic resin and the boundary is not specified.

Furthermore, the liquid developer in which the toner particles are dispersed in the carrier liquid is present in a state where the surface of the toner particle is in contact with the carrier liquid. Further, it is thought that the thermoplastic elastomer resin has rather higher affinity with the carrier liquid, as compared with the thermoplastic resin.

For this reason, for example, if a toner particle in which a thermoplastic elastomer resin is present unevenly and the boundary between an area of the thermoplastic elastomer resin and an area of the thermoplastic resin clearly exists, the carrier liquid is easily absorbed into the area of the thermoplastic elastomer resin exposed to the surface of the toner particles, and the carrier liquid easily moves into the boundary. Further, it is thought that when the carrier liquid which moves into the boundary completely functions as an adhesive by crosslinking the toner particles with each other, the toner particles are aggregated, and it is also thought that when aggregation of the toner particles proceeds, the liquid developer is gelled in some cases.

With this regard, in the present exemplary embodiment, it is difficult for the thermoplastic elastomer resin to be present unevenly, as described above, and even though it is present unevenly, the boundary is likely to be ambiguous. For this reason, it is thought that it is difficult for the carrier liquid to be absorbed into an area of the thermoplastic elastomer resin exposed to the surface of the toner particles, or it is difficult for the carrier liquid to move into the boundary and aggregation of the toner particles is difficult, as described above.

Moreover, by using the liquid developer of the present exemplary embodiment, for example, even when the liquid developer is used after being left to stand or even when the liquid developer is left to stand in a developer cartridge or an image forming apparatus, a poor state during formation of an image due to aggregation of the toner particles (for example, toner clogging in a supply roller or a developing roller, image density unevenness due to variance of the solid content concentration, reduction of color reproducibility, or the like) is inhibited, and thus, an image having good image quality (for example, having little defects of image quality) is formed.

Furthermore, in the present exemplary embodiment, when the content of the thermoplastic elastomer resin in the binder resin is within the above-described range, aggregation of the toner particles is difficult even when the liquid developer is left to stand, as compared with a case where the content is out of the above-described range. The reason therefor is not clear, but it is presumed that when the content of the thermoplastic elastomer resin is within the above-described range, the compatibility between the thermoplastic resin and the thermoplastic elastomer resin easily increases, and thus, the resins easily become a continuous state, as compared with a case where the content is out of the above-described range.

Furthermore, in the present exemplary embodiment, when the liquid developer is configured so that the binder resin has the above-described constitution and a charge control agent is adhered to the surface of the toner particles, aggregation of the toner particles is more difficult when the liquid developer is left to stand, as compared with a case where the binder resin has a constitution other than the above-described constitution (for example, a constitution where a thermoplastic elastomer resin other than the styrene-alkylene-styrene block copolymer is used, or the like), and a charge control agent is adhered to the toner particle surface.

The reason therefor is not clear, but in the present exemplary embodiment, it is thought that it is difficult for the thermoplastic elastomer resin to be present unevenly, and even though it is present unevenly, the boundary is likely to be ambiguous, as described above, and thus, a charge control agent is easily adhered evenly to the surface of the toner particles. For this reason, it is thought that in the present exemplary embodiment, it is difficult for the crosslinking between the toner particles due to the carrier liquid to occur, and additionally, the electrostatic repulsion effect of the charge control agent is easily obtained in the entire surface of the toner particles. Further, in the present exemplary embodiment, it is presumed that the boundary is clear in an area where the thermoplastic elastomer resin is present unevenly, and thus, aggregation of the toner particles is more difficult, as compared with a case where the charge control agent adhered to the surface of the toner particles is present unevenly.

Hereinbelow, the components constituting the liquid developer will be described in more detail.

<Toner Particles>

As described above, the toner particle have at least a binder resin containing a thermoplastic resin which is a styrene-acrylic ester copolymer and a thermoplastic elastomer resin which is a styrene-alkylene-styrene block copolymer, and may include, as required, other components such as a colorant, a release agent, and the like. Further, as described above, in the toner particle, a charge control agent may be adhered to the surface thereof.

—Thermoplastic Resin—

In the present exemplary embodiment, a styrene-acrylic ester copolymer is used as a thermoplastic resin, as described above. The styrene-acrylic ester copolymer is a resin having repeating units derived from a styrene-based monomer and repeating units derived from an acrylic ester-based monomer, as described above, and is obtained by, for example, polymerization of the styrene-based monomers and the acrylic ester-based monomers.

The styrene-based monomer is a monomer having a styrene skeleton and specifically examples thereof include styrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene, 3,4-dichlorostyrene, and the like. These may be used singly or in combination of two or more kinds thereof.

The acrylic ester-based monomer is a monomer having an acrylic ester structure, and examples thereof include an acrylic ester, a methacrylic ester, and the like.

Specific examples of the acrylic ester-based monomer include alkyl esters of (meth)acrylic acid, such as methyl (meth)acrylate, ethyl(meth)acrylate, propyl(meth)acrylate, n-butyl(meth)acrylate, isobutyl(meth)acrylate, n-octyl (meth)acrylate, dodecyl(meth)acrylate, 2-ethylhexyl acrylate, stearyl(meth)acrylate, and the like, 2-chloroethyl acrylate, phenyl(meth)acrylate, methyl α-chloroacrylate, 2-hydroxyethyl(meth)acrylate, 2-hydroxypropyl (meth)acrylate, 2-hydroxybutyl(meth)acrylate, glycidyl (meth)acrylate, dimethylaminoethyl methacrylate, diethylaminoethyl methacrylate, bisglycidyl methacrylate, polyethylene glycol dimethacrylate, methacryloxyethyl phosphate, and the like, and these may be used singly or in combination of two or more kinds thereof. Furthermore, the "(meth)acryl" means any one or both of acryl and methacryl.

The styrene-acrylic ester copolymer has repeating units derived from a styrene-based monomer and repeating units derived from an acrylic ester-based monomer, and may or may not include, as required, repeating units derived from another monomer, as described above. Further, if the repeating units derived from another monomer are included, the amount thereof may be 5% by mass or less or 3% by mass or less, based on the total styrene-acrylic ester copolymer.

Examples of other monomers include olefin-based monomers such as ethylene, propylene, butylene, butadiene, isoprene, and the like, vinyl ester-based monomers such as vinyl formate, vinyl acetate, vinyl propionate, vinyl benzoate, and the like, acrylic acids such as acrylic acid, methacrylic acid, α-ethyl acrylic acid, crotonic acid, and the like, and α- or β-alkyl derivatives thereof; unsaturated dicarboxylic acids such as fumaric acid, maleic acid, citraconic acid, itaconic acid, and the like, and monoester derivatives or diester derivatives thereof; mono(meth)acryloyloxyethyl succinate ester, (meth)acrylonitrile, acrylamide, and the like.

The weight average molecular weight (Mw) of the thermoplastic resin may be, for example, in the range of 150000 or more and 500000 or less.

Furthermore, the molecular weight distribution (Mw/Mn) of the thermoplastic resin may be, for example, in the range of 2 or more and 20 or less.

Furthermore, the thermoplastic resin may have plural peaks or shoulders in the molecular weight distribution measured by gel permeation chromatography (GPC).

The weight average molecular weight (Mw) is measured by gel permeation chromatography (GPC). For measurement of molecular weights by means of GPC, GPC•HLC-8120 manufactured by Tosoh Corporation and Column/TSK gel Super HM-M (15 cm) manufactured by Tosoh Corporation are used as a measurement apparatus, and the measurement is carried out in THF as a solvent. Further, the weight average molecular weight is calculated using a molecular weight calibration curve prepared by monodisperse polystyrene as a standard sample from the measurement results. Measurement of the weight average molecular weights is as above. Further, the number average molecular weights (Mn) are measured in the same manner as for the weight average molecular weights (Mw), and from the values, molecular weight distributions (Mw/Mn) are calculated.

The content ratio of the thermoplastic resin in the toner particle may be, for example, 50% by mass or more and 90% by mass or less, or 50% by mass or more and 70% by mass or less, based on the total toner particle.

—Thermoplastic Elastomer Resin—

In the present exemplary embodiment, as described above, a styrene-alkylene-styrene block copolymer is used as a thermoplastic elastomer resin. As described above, the styrene-alkylene-styrene block copolymer is a block copolymer in which a first block portion including repeating units derived from a styrene-based monomer, a second block portion including repeating units derived from an alkene having the number of carbon atoms in the above-described range, and a third block portion including repeating units derived from a styrene-based monomer are bonded in this order.

Here, examples of the "thermoplastic elastomer resin" include ones having the properties of rubber at 25° C. and having the properties of thermoplastic plastics at high temperatures (for example, an MFR of 5.0 g/min or more at 230° C. as defined in ISO 1133).

Examples of the styrene-based monomer include the same styrene-based monomers mentioned as specific examples of the styrene-based monomer in the thermoplastic resin, and these may be used singly or in combination of two or more kinds thereof.

Examples of the alkene having the number of carbon atoms in the above-described range include ethylene, propylene, butylene, and the like, and these may be used singly or in combination of two or more kinds thereof. The number of carbon atoms of the alkene is 2 or more and 6 or less, as described above, and may be 2 or more and 5 or less, or 2 or more and 4 or less.

Specific examples of the thermoplastic elastomer resin include a styrene-ethylene-styrene block copolymer, a styrene-ethylene/butylene-styrene block copolymer, a styrene-butylene-styrene block copolymer, a styrene-isoprene-styrene block copolymer, a styrene-ethylene/propylene-styrene block copolymer, a styrene-propylene-styrene copolymer, and the like.

Furthermore, in the specific examples, for example, the "styrene-ethylene/butylene-styrene" refers to a block copolymer in which a first block portion of styrene (that is, a block of repeating units derived from a styrene monomer), a second block portion of ethylene and butylene (that is, a block having a combination of repeating units derived from an ethylene monomer and repeating units derived from a butylene monomer), and a third block portion of styrene are bonded in this order.

The weight average molecular weight of the thermoplastic elastomer resin may be, for example, in the range of 30000 or more and 300000 or less.

Furthermore, the proportion of the repeating units derived from alkene relative to the total thermoplastic elastomer resin may be, for example, in the range of 10% by mass or more and 70% by mass or less or in the range of 20% by mass or more and 60% by mass or less.

The content ratio of the thermoplastic elastomer in the binder resin may be in the range of 10% by mass or more and 50% by mass or less (or about 10% by mass or more and about 50% by mass or less), in the range of 15% by mass or more and 40% by mass or less, or in the range of 20% by mass or more and 40% by mass or less.

—Other Components—

The toner particles may contain, if required, other components such as other resins, colorants, release agents, charge control agents, silica powders, metal oxides, and the like, in addition to a vinyl-based resin and a styrene-based thermoplastic elastomer resin. These other components may be internally added to the vinyl-based resin and the styrene-based thermoplastic elastomer resin by kneading or the like, or may be externally added by carrying out a mixing treatment after obtaining toner particles. In addition, when the toner particles are used to give a transparent toner, colorants may not be contained.

Examples of other resins as above include well-known binder resins, for example, polyesters, polyethylene, polypropylene, polyurethane, epoxy resins, silicone resins, polyamides, modified rosin, paraffin wax, and the like. In a case where the toner particles contain other resins as above, the content of other resins to the total toner particles may be, for example, 10% by mass or less.

In addition, the toner particles may contain a polyester resin as an additive for regulating the glass transition temperature of the toner particle or as a release agent that will be described later, and in this case, the content of the polyester resin may be, for example, in the range of less than 5% by mass, based on the total resin.

As the colorant, known pigments or dyes are used. Specific examples thereof include a yellow pigment, a magenta pigment, a cyan pigment, and a black pigment, respectively, as shown below.

Examples of the yellow pigment include compounds typically exemplified by a condensed azo compound, an isoindolinone compound, an anthraquinone compound, an azo metal complex compound, a methine compound, and an aryl amide compound.

Examples of the magenta pigment include a condensed azo compound, a diketopyrrolo-pyrrole compound, anthraquinone, a quinacridone compound, a base dye lake compound, a naphthol compound, a benzoimidazolone compound, a thioindigo compound, and a perylene compound.

Examples of the cyan pigment include a copper phthalocyanine compound or a derivative thereof, an anthraquinone compound, a base dye lake compound, and the like.

Examples of the black pigment include carbon black, aniline black, acetylene black, iron black, and the like.

The release agent is not particularly limited, but examples thereof include vegetable waxes such as carnauba wax, sato wax, wood wax, and the like; animal waxes such as beeswax, insect wax, whale wax, wool wax, and the like; and synthetic hydrocarbon wax such as Fischer-Tropsch wax (FTwax) having an ester in a side chain, polyethylene wax, polypropylene wax, polyester wax, and the like. The release agents may be singular or a combination of two or more kinds thereof.

The charge control agent is not particularly limited, and a commercially known charge control agent is used. Examples thereof include positively-charging charge control agents such as a nigrosine dye, a fatty acid modified nigrosine dye, a carboxyl group-containing fatty acid modified nigrosine dye, a quaternary ammonium salt, an amine compound, an amide compound, an imide compound, an organic metal compound, and the like; and negatively-charging charge control agents such as an oxycarboxylic acid metal complex, a metal complex of an azo compound, a metal complex salt dye, a salicylic acid derivative, and the like. The charge control agents may be singular or a combination of two or more kinds thereof.

The metal oxide is not particularly limited, and examples thereof include titanium oxide, aluminum oxide, magnesium oxide, zinc oxide, strontium titanate, barium titanate, magnesium titanate, calcium titanate, and the like. The metal oxides may be singular or a combination of two or more kinds thereof.

—Charge Control Agent—

The toner particles may have a charge control agent which is adhered to the surface thereof. The charge control agent to be adhered to the surface of the toner particles is not particularly limited, and it may be any one of a positively-charging charge control agent and a negatively-charging charge control agent.

Examples of the positively-charging charge control agent include charge control resins prepared in Preparation Example (1) and Preparation Example (2) described in JP-R-5-119543, charge control agents of Preparation Example 1 described in JP-B-6-23865, and the like, and these may be used singly or in combination of two or more kinds thereof.

Furthermore, examples of the negatively-charging charge control agent include SOLSPERSE 13940 (manufactured by Lubrizol Corporation), SOLSPERSE 20000 (manufactured by Lubrizol Corporation), aluminum (di)stearate (manufactured by Wako Pure Chemical Industries, Ltd.), and the like, and these may be used singly or in combination of two or more kinds thereof.

Examples of the method for adhering a charge control agent to the toner particles include a method in which the obtained toner particles and a charge control agent are mixed by a homogenizer mixer or the like to adhere the charge control agent to the surface of the toner particles, a method in which the toner particles and a carrier liquid are mixed and then a charge control agent is added thereto and mixed therewith to adhere the charge control agent to the surface of the toner particles, and the like.

The amount of the charge control agent to be added may be, for example, in the range of 0.0001 part by mass or more and 1.0 part by mass or less, or in the range of 0.0005 part by mass or more and 0.1 part by mass or less, based on 100 parts by mass of the toner particle.

—Method for Preparing Toner Particles—

The method for preparing the toner particles used in the present exemplary embodiment is not particularly limited, and the toner particles are prepared by, for example, a method for preparing the pulverized toner particles, dry toner particles in a liquid emulsion, or polymerized toner particles. Further, if required, by adding the charge control agent or other external additives to the obtained toner particles and performing a mixing treatment, the charge control agent or other external additives are externally added to the toner particles.

Specifically, the pulverized toner particles can be obtained, for example, by introducing a binder resin including a thermoplastic elastomer resin and a thermoplastic resin, and if required, a colorant and other additives into a mixing device such as a Henschel mixer and the like and mixing them, melt-kneading the mixture by a biaxial extruder or the like, then cooling the mixture by a drum flaker or the like, coarsely pulverizing the mixture with a pulverizer such as a hammer mill and the like and further finely pulverizing with a pulverizer such as a jet mill and the like, and then classifying the mixture using an air classifier and the like.

In addition, the dry toner particles in a liquid emulsion are obtained, for example, by dissolving a binder resin including a thermoplastic elastomer resin and a thermoplastic resin, and as required, a colorant and other additives in a solvent such as ethyl acetate and the like, emulsifying/suspending them in water, to which a dispersion stabilizer such as calcium carbonate and the like is added, to remove the solvent, removing the dispersion stabilizer, and then filtering/drying the obtained particles.

Furthermore, the polymerized toner particles are obtained, for example, by adding a composition including polymerizable monomers constituting a binder resin, and as required, a colorant, a polymerization initiator (for example, benzoyl peroxide, lauroyl peroxide, isopropylperoxycarbonate, cumenehydroperoxide, 2,4-dichlorobenzoyl peroxide, methylethylketone peroxide, and the like), and other additives, or the like into an aqueous phase under stirring for granulation, subjecting the mixture to a polymerization reaction, and then filtering/drying the particles.

Moreover, the blending ratio of the respective materials (the thermoplastic elastomer and the thermoplastic resin, and as required, the colorant, other additives, and the like) when the toner is obtained is determined, taking into consideration the required characteristics, the color, and the like.

Furthermore, the toner particles obtained by the above-described method are finely pulverized in a carrier oil by using, for example, a known pulverization device such as a ball mill, a bead mill, a high-pressure wet type atomization device, and the like, thereby obtaining toner particles for the liquid developer of the present exemplary embodiment.

—Characteristics of Toner Particles—

The volume average particle diameter, D50v, of the toner particles may be, for example, in the range of 0.5 μm or more and 5.0 μm or less, in the range of 0.8 μm or more and 4.0 μm or less, or in the range of 1.0 μm or more and 3.0 μm or less.

For the toner particles having a size of 2 μm or more, the volume average particle diameter, D50v, of the toner particles is measured by a measurement apparatus of a particle size pulverizer, Multisizer (manufactured by Beckman Coulter, Inc.). For the toner particles having a size of less than 2 μm, the volume average particle diameter is measured using a dynamic light scattering type particle size distribution measurement apparatus (for example, LB-500 (manufactured by HORIBA, Ltd.), Microtrac UPA (manufactured by Nikkiso Ltd.), and the like), or a laser diffraction/scattering type particle size distribution measurement apparatus (for example, LS13 320 (manufactured by Beckman Coulter, Inc.), or the like). Based on the particle size distribution obtained by the above-described method, for the divided range of the particle sizes (channel), a cumulative distribution is drawn from the side of a small diameter in terms of volume, and a particle diameter equivalent to cumulative 50% is defined as a volume D50v.

The content of the toner particles may be, for example, in the range of 0.5% by mass or more and 40% by mass or less or in the range of 1% by mass or more and 30% by mass or less, based on the total liquid developer.

<Carrier Liquid>

The carrier liquid is a liquid in which the toner particles are dispersed and is not particularly limited. However, examples thereof include non-aqueous solvents having a volume resistivity of $1.0\times10^{10}$ Ω·cm or more, and among those, particularly, non-aqueous solvents in which the binder resin is difficult to dissolve (that is, the toner particles are present as a solid in the liquid developer).

The non-aqueous solvent refers to a solvent other than water, and it may be a mixture of water and a solvent other than water, or may be a solvent which does not include water positively.

Examples of the non-aqueous solvent include aliphatic hydrocarbon solvents such as paraffin oil and the like (examples of its commercially available products include Moresco White MT-30P, Moresco White P40, and Moresco White P70 manufactured by Matsumura Oil Research Corp., and Isopar L, Isopar M, and the like manufactured by Exxon Chemical Co.), hydrocarbon solvents such as naphthenic oil and the like (examples of its commercially available products include Exxsol D80, Exxsol D110, and Exxsol D130 manufactured by Exxon Chemical Co., and Naphtesol L, Naphtesol M, Naphtesol H, New Naphtesol 160, New Naphtesol 200, New Naphtesol 220, New Naphtesol MS-20P, and the like manufactured by Nippon Petrochemicals Co.), in which an aromatic compound such as toluene and the like may be contained.

The non-aqueous solvents may be used singly or in a mixture of two or more kinds thereof in the component, and in a case where the non-aqueous solvents are used in a mixture of two or more kinds thereof, examples thereof include a mixed solvent of a paraffin-based solvent and a vegetable oil, and a mixed solvent of a silicone-based solvent and vegetable oil.

—Characteristics of Carrier Liquid—

The volume resistivity of the carrier liquid may be, for example, in the range of $1.0\times10^{10}$ Ω·cm or more and $1.0\times10^{14}$ Ω·cm or less or in the range of $1.0\times10^{10}$ Ω·cm or more and $1.0\times10^{13}$ Ω·cm or less.

The liquid developer may contain additionally other components, if required. Examples of the other components include a curable material, a dispersant, an emulsifier, a surfactant, an antioxidant, a wetting agent, a thickener, a foaming agent, a defoaming agent, a coagulant, a gelling agent, an anti-settling agent, an antistatic agent, an anti-aging agent, a softener, a plasticizer, a filler, a perfuming agent, an anti-adhesive, a release agent, and the like.

<Method for Preparing Liquid Developer>

The liquid developer is obtained by mixing the above-described toner particles (if required, toner-particles in which a charge control agent or the like is adhered to the surface thereof), a carrier liquid, and if required, other components using a dispersing apparatus such as a ball mill, a sand mill, an attritor, a roll mill, and the like, and pulverizing them to disperse the toner particles in the carrier liquid. Further, as described above, in a case where a charge control agent is used, the charge control agent may be adhered to the surface of the toner particles in advance, and then dispersed in a carrier liquid, or the toner particles may be dispersed in a carrier liquid and then a charge control agent may be added and adhered to the surface of the toner particles.

Furthermore, dispersion of the toner particles in a carrier liquid is not limited to a dispersing apparatus, and the toner particles may be dispersed by rotation of a specific impeller as in a mixer, or may be dispersed by a shear force of a known rotor/stator with a homogenizer or by ultrasonic waves.

Thereafter, the obtained dispersion may be filtered, for example, using a membrane filter having a pore diameter of 100 and the waste and the coarse particles may be removed.

[Developer Cartridge]

The developer cartridge of the present exemplary embodiment is a developer cartridge in which the liquid developer of the present exemplary embodiment is stored, and for example, the liquid developer stored in the developer cartridge is supplied to a developing device of an image forming apparatus via a supply pipe or the like. The developer cartridge may be configured to be attached to or detached from an image forming apparatus in order to exchange a liquid developer when the residue of the liquid developer in the developer cartridge is exhausted.

[Image Forming Method and Image Forming Apparatus]

The image forming method of the present exemplary embodiment is an image forming method including forming a latent image on the surface of a latent image holding member; developing the latent image formed on the surface of the latent image holding member by the liquid developer of the present exemplary embodiment held on the surface of a developer holding member to form a toner image; transferring the toner image formed on the surface of the latent image holding member onto a recording medium; and fixing the toner image transferred to the recording medium on the recording medium to form a fixed image.

The image forming apparatus of the present exemplary embodiment is an image forming apparatus, including a latent image holding member; a latent image forming unit that forms a latent image on the surface of the latent image holding member; a developing unit that has a developer holding member, and develops the latent image formed on the surface of the latent image holding member by the liquid developer of the present exemplary embodiment held on the surface of a developer holding member to form a toner image; a transfer unit that transfers the toner image formed on the surface of the latent image holding member to a recording medium; and a fixing unit that fixes the toner image transferred to the recording medium on the recording medium to form a fixed image.

Hereinbelow, the image forming method and the image forming apparatus, in each of which the liquid developer is used, in the present exemplary embodiment, will be described with reference to the figures.

FIG. 1 is a schematic constitutional view showing an example of the image forming apparatus of the present exemplary embodiment.

An image forming apparatus 100 is configured to include, for example, a photoreceptor 10 (latent image holding member), a charging device 20, an exposure device 12 (wherein the charging device 20 and the exposure device 12 constitute an electrostatic latent image forming unit), a developing device 14 (developing unit), an intermediate transfer medium 16, a cleaner 18, and a transfer fixing roller 28 (the intermediate transfer medium 16 and the transfer fixing roller 28 constitute a transfer unit, and the transfer fixing roller 28 also has a fixing unit). The photoreceptor 10 has a cylindrical shape, and the charging device 20, the exposure device 12, the developing device 14, the intermediate transfer medium 16, and the cleaner 18 are arranged sequentially on the outer periphery of the photoreceptor 10.

Brief description of the operation of the image forming apparatus 100 will be presented below.

The charging device 20 charges the surface of the photoreceptor 10 to a predetermined potential, the charged surface is exposed by the exposure device 12 by means of, for example, laser beam, based on the image signal, to form an electrostatic latent image.

The developing device 14 is configured to include a developing roller 14*a* (developer holding member) and a developer storing container 14*b*. The developing roller 14*a* is provided so that a part of a liquid developer 24 stored in the developer storing container 14*b* may be soaked. Further, developer storing container 14*b* may be configured so that the liquid developer 24 may be supplied from a liquid developer cartridge not shown. In addition, the liquid developer cartridge may be configured to be attached to or detached from the image forming apparatus so that when the residual amount of the liquid developer 24 is exhausted, it can be exchanged.

In the liquid developer 24, the toner particles are dispersed, but for example, by continuously stirring the liquid developer 24 additionally by a stirring member provided in the developer storing container 14*b*, the positional variability of the concentration of the toner particles in the liquid developer 24 may be reduced. By this, to the developing roller 14*a* which rotates in the direction of an arrow A in the drawing, the liquid developer 24 having reduction of the dispersion of the concentration of the toner particles is supplied.

The liquid developer 24 supplied to the developing roller 14*a* is transported to the photoreceptor 10 in a state where the supply amount is limited to a constant amount by a regulating member, and supplied to the electrostatic latent image at a position close to (in contact with) the developing roller 14*a* and the photoreceptor 10. By this, the electrostatic latent image is developed to form a toner image 26.

The developed toner image 26 is transported to the photoreceptor 10 that rotates in the direction of an arrow B in the drawing and transferred to paper (recording medium) 30. However, in the present exemplary embodiment, before being transferred to the paper 30, in order to improve the transfer efficiency of the toner image to the recording medium, including the peeling efficiency of the toner image from the photoreceptor 10, and thus, carry out the transfer to the recording medium and the fixing at the same time, the toner image is first transferred to the intermediate transfer medium 16. At this time, a peripheral speed difference between the photoreceptor 10 and the intermediate transfer medium 16 may be provided.

Subsequently, the toner image transported in the direction of an arrow C in the drawing by the intermediate transfer medium 16 is transferred to and fixed on the paper 30 at a position in contact with the transfer fixing roller 28.

The transfer fixing roller 28 makes the toner image closely adhered on the intermediate transfer medium 16 to the paper 30, while having the intermediate transfer medium 16 and the paper 30 therebetween. By this, the toner image is transferred to the paper 30 and the toner image is fixed on the paper to become a fixed image 29. The fixing may be carried out by pressurizing and heating by providing a heating element on a transfer fixing roller 28. The fixing temperature may be, for example, 100° C. or higher and 180° C. or lower.

If the intermediate transfer medium 16 has a roller shape as shown in FIG. 1, in order to constitute the transfer fixing roller 28 and the roller pair, the intermediate transfer medium 16 and the transfer fixing roller 28 are configured according to the fixing roller and the pressing roller in each fixing device to exhibit a fixing function. That is, when the paper 30 passes through the contact section between the transfer fixing roller 28 and the intermediate transfer medium 16, for example, the toner image is transferred while be heated and pressed against the intermediate transfer medium 16 by the transfer fixing roller 28. By this, for example, while the binder resin in the toner particles constituting the toner image is softened, the toner image infiltrates into the fibers of the paper 30 to form a fixed image 29 on the paper 30.

In the present exemplary embodiment, the transfer to the paper 30 and the fixing are carried out at the same time, but the transferring and the fixing are separated, and thus, the transfer is carried out and then the fixing may be carried out.

On the other hand, in the photoreceptor 10 in which the toner image 26 is transferred to the intermediate transfer medium 16, the remaining toner particles in the photoreceptor 10, that are not transferred, are transferred to the contact position with the cleaner 18 and recovered in the cleaner 18. Further, the transfer efficiency is close to 100%, and thus, if the remaining toner has no problem, there is no need to provide the cleaner 18.

The image forming apparatus may be provided with an erasing device (not shown) that removes the charge on the surface of the photoreceptor 10 after the transfer and until the next charging.

All of the charging device 20, the exposure device 12, the developing device 14, the intermediate transfer medium 16, the transfer fixing roller 28, and the cleaner 18, provided in the image forming apparatus 100, may be operated in synchronization with, for example, the rotation speed of the photoreceptor 10.

EXAMPLES

Hereinbelow, some embodiments of the present invention will be described in more detail with reference to Examples. However, these Examples are not intended to limit the present invention. Furthermore, in the context, "parts" and "%" indicate "parts by mass" and "% by mass", respectively, unless particularly otherwise stated.

<Preparation of Liquid Developer>

—Preparation of Liquid Developer A1—

To 60 parts of a thermoplastic resin 1 (styrene-butyl acrylate resin, manufactured by Fujikura Kasei Co., Ltd., trade name: FSR-051, weight average molecular weight: 390000) is added 40 parts of cyan pigment C. I. pigment blue 15:3 (manufactured by Clariant (Japan) K. K.), and the mixture is kneaded with a pressurization kneader. This kneading product is coarsely pulverized to prepare a cyan pigment master batch.

Next, a mixture having the following composition is kneaded again with a pressurization kneader to obtain a mixture 1.

Cyan pigment master batch: 25 parts

Thermoplastic resin 2 (styrene-butyl acrylate resin, manufactured by Fujikura Kasei Co., Ltd., trial product: KEY-1000, weight average molecular weight: 220000): 55 parts Thermoplastic elastomer resin 1 (manufactured by Asahi Kasei Corporation, trial product: S. O. E. L605, styrene-butylene-styrene block copolymer): 20 parts The obtained mixture is pulverized with a jet mill to obtain cyan particles having a volume average particle diameter of 10 μm.

To 15 parts of the obtained cyan particle are added 84 parts of paraffin oil (manufactured by Matsumra Oil Co., Ltd., trade name: Moresco White P40) as a non-aqueous solvent, and part of a dispersant (manufactured by The Lubrizol Corporation, trade name: SOLSPERSE 20000), and the resulting mixture is finely pulverized with a ball mill to give a volume average particle diameter of 1.1 μm.

Furthermore, 0.001 part of a positively-charging charge control agent (a high-molecular-weight compound having a charge control agent described in JP-B-6-23865, Compound Preparation Example 1, and a semi-maleic amide component and maleimide component) as a charge control agent is added thereto and stirred using ultrasonic waves for 1 minute, and the charge control agent is adhered to the toner particle surface to obtain a liquid developer A1.

The content of the thermoplastic resin in the binder resin and the content of the thermoplastic elastomer resin in the binder resin are shown in Table 1.

—Preparation of Liquid Developer A2—

In the same manner as for the liquid developer A1 except that 0.001 part of a negatively-charging charge control agent (aluminum distearate) is used instead of the positively-charging charge control agent as a charge control agent, a liquid developer A2 is obtained.

—Preparation of Liquid Developer A3—

In the same manner as for the liquid developer A1 except that a charge control agent is not used, a liquid developer A3 is obtained.

—Preparation of Liquid Developers A4 to A6—

In the same manner as for the liquid developer A1 except that the amounts of the thermoplastic resin 2 and the thermoplastic elastomer resin 1 to be added are changed to adjust the content of the thermoplastic resin in the binder resin and the content of the thermoplastic elastomer resin in the binder resin to ones shown in Table 1, liquid developers A4 to A6 are obtained.

—Preparation of Liquid Developer A7—

In the same manner as for the liquid developer A1 except that a thermoplastic resin 3 (styrene-butyl acrylate resin, manufactured by Fujikura Kasei Co., Ltd., trade name: FSR-053, weight average molecular weight: 320000) is used instead of the thermoplastic resin 2, a liquid developer A7 is obtained.

—Preparation of Liquid Developer B1—

In the same manner as for the liquid developer A1 except that 20 parts of the thermoplastic elastomer resin 2 (manufactured by Asahi Kasei Corporation, trade name: L611, styrene-butylene/butadiene-styrene block copolymer) is used instead of the thermoplastic elastomer resin 1, a liquid developer B1 is obtained.

—Preparation of Liquid Developer B2—

In the same manner as for the liquid developer A1 except that the thermoplastic elastomer resin 3 (manufactured by Asahi Kasei Corporation, trade name: Tufprene A, styrene-butadiene-styrene block copolymer: styrene/butadiene weight ratio-40/60) is used instead of the thermoplastic elastomer resin 1, a liquid developer B2 is obtained.

—Preparation of Liquid Developer B3—

In the same manner as for the liquid developer B2 except that a charge control agent is not used, a liquid developer B3 is obtained.

<Evaluation on Liquid Developer>

Evaluation is carried out using a dispersion in which paraffin oil is added to a liquid developer to adjust the solid content concentration (that is, the content of the toner particles in the liquid developer) to 5% by mass.

Specifically, evaluation is carried out for visual observation at after 30 minutes, 60 minutes, 120 minutes, and 240 minutes after 0.8 ml of the dispersion is weighed into a 1.0 ml test tube, and then left to stand. The evaluation criteria are as follows and shown in Table 1.

—Evaluation Criteria—

G1: The entire portion is uniformly colored after 30 minutes, 60 minutes, 120 minutes, and 240 minutes.

G2: The entire portion is uniformly colored after 30 minutes, 60 minutes, and 120 minutes, but after 240 minutes, the supernatant is colorless and clear.

G3: The entire portion is uniformly colored after 30 minutes and 60 minutes, but after 120 minutes and 240 minutes, the supernatant is colorless and clear.

G4: The entire portion is uniformly colored after 30 minutes, but after 60 minutes, 120 minutes, and 240 minutes, the supernatant is colorless and clear.

G5: The supernatant is colorless and clear at any time after 30 minutes, 60 minutes, 120 minutes, and 240 minutes.

TABLE 1

| | Liquid developer | Content of thermo-plastic resin (% by mass) | Content of thermo-plastic elastomer resin (% by mass) | Charge control agent | Evalu-ation |
|---|---|---|---|---|---|
| Example 1 | A1 | 78 | 22 | Positively-charging | G1 |
| Example 2 | A2 | 78 | 22 | Negatively-charging | G1 |
| Example 3 | A3 | 78 | 22 | None | G3 |
| Example 4 | A4 | 50 | 50 | Positively-charging | G3 |
| Example 5 | A5 | 90 | 10 | Positively-charging | G2 |
| Example 6 | A6 | 60 | 40 | Positively-charging | G3 |
| Example 7 | A7 | 78 | 22 | Positively-charging | G1 |
| Comparative Example 1 | B1 | 78 | 22 | Positively-charging | G4 |
| Comparative Example 2 | B2 | 78 | 22 | Positively-charging | G5 |
| Comparative Example 3 | B3 | 78 | 22 | None | G5 |

Using the image forming apparatus shown in FIG. 1, the liquid developer after being left to stand for 120 minutes is set in a developing device, and a toner image at 3.5 cm×3.5 cm (amount of the toner attached: 4 g/m$^2$) is formed. In any case where the liquid developer in which the entire portion is uniformly colored after being left to stand for 120 minutes, an image having a good image quality is formed. On the other hand, in any case where the liquid developer in which the supernatant is colorless and clear after being left to stand for 120 minutes, an image having image density unevenness is formed.

As can be seen from the results in Table 1, in Examples, aggregation of the toner particles is difficult even when the liquid developer is left to stand, as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid; and toner particles dispersed in the carrier liquid, the toner particles including a binder resin which contains a thermoplastic resin having repeating units derived from a monomer having a styrene skeleton and repeating units derived from a monomer having an acrylic ester structure, and a thermoplastic elastomer resin that is a block copolymer, the block copolymer having a first block portion including repeating units derived from a monomer having a styrene skeleton, a second block portion including repeating units derived from an alkene having 2 to 6 carbon atoms, and a third block portion including repeating units derived from a monomer having a styrene skeleton, the first, second, and third block portions being bonded in this order, wherein the content of the thermoplastic elastomer resin based on the total binder resin is from 20% by mass to 40% by mass.

2. The liquid developer according to claim 1, further comprising a charge control agent adhered to the surface of the toner particles.

3. A developer cartridge in which the liquid developer according to claim 1 is stored.

4. The developer cartridge according to claim 3, wherein the toner of the liquid developer contains a charge control agent adhered to the surface of the toner particles.

5. An image forming method comprising:

forming a latent image on the surface of a latent image holding member;

developing the latent image formed on the surface of the latent image holding member by the liquid developer according to claim 1 held on the surface of a developer holding member to form a toner image;

transferring the toner image formed on the surface of the latent image holding member onto a recording medium; and fixing the toner image transferred to the recording medium on the recording medium to form a fixed image.

6. The image forming method according to claim 5, wherein the toner of the liquid developer contains a charge control agent adhered to the surface of the toner particles.

7. An image forming apparatus comprising:

a latent image holding member;

a latent image forming unit that forms a latent image on the surface of the latent image holding member;

a developing unit that stores the liquid developer according to claim 1, has a developer holding member, and develops the latent image formed on the surface of the latent image holding member by the liquid developer held on the surface of the developer holding member to form a toner image;

a transfer unit that transfers the toner image formed on the surface of the latent image holding member to a recording medium; and a fixing unit that fixes the toner image transferred to the recording medium on the recording medium to form a fixed image.

8. An image forming apparatus according to claim 7, wherein the toner of the liquid developer contains a charge control agent adhered to the surface of the toner particles.

9. The liquid developer according to claim 1, wherein the alkene is butylene.

* * * * *